US007828067B2

(12) United States Patent
Scott et al.

(10) Patent No.: US 7,828,067 B2
(45) Date of Patent: Nov. 9, 2010

(54) INFLOW CONTROL DEVICE

(75) Inventors: Brian Scott, Kuala Lumpur (MY); William Thomas Rouse, Montgomery, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 52 days.

(21) Appl. No.: 11/694,336

(22) Filed: Mar. 30, 2007

(65) Prior Publication Data

US 2008/0236843 A1 Oct. 2, 2008

(51) Int. Cl.
*E21B 33/12* (2006.01)

(52) U.S. Cl. ..... 166/386; 166/53

(58) Field of Classification Search ..... 166/53, 166/319, 376, 386
See application file for complete search history.

(56) References Cited

U.S. PATENT DOCUMENTS

| | | | | |
|---|---|---|---|---|
| 6,371,210 | B1 | 4/2002 | Bode et al. | |
| 6,976,542 | B2 * | 12/2005 | Henriksen et al. | 166/386 |
| 7,407,007 | B2 * | 8/2008 | Tibbles | 166/278 |
| 2006/0175065 | A1 * | 8/2006 | Ross | 166/386 |
| 2007/0246213 | A1 * | 10/2007 | Hailey | 166/278 |
| 2007/0246225 | A1 | 10/2007 | Hailey, Jr. et al. | |
| 2008/0066900 | A1 * | 3/2008 | Saebi et al. | 166/51 |
| 2008/0149323 | A1 * | 6/2008 | O'Malley et al. | 166/53 |

FOREIGN PATENT DOCUMENTS

| | | |
|---|---|---|
| WO | WO 02/08562 | 1/2002 |
| WO | WO 2006/130748 | 7/2006 |

OTHER PUBLICATIONS

GB Search Report from Application No. GB0805527.9 dated Jul. 8, 2008.
Canadian Office Action for Canadian Application No. 2,627,141 dated Sep. 16, 2009.
Canadian Office Action for Application No. 2,627,141 dated Mar. 31, 2010.

* cited by examiner

*Primary Examiner*—William P Neuder
(74) *Attorney, Agent, or Firm*—Patterson & Sheridan, L.L.P.

(57) ABSTRACT

The present invention generally relates to the control of fluid flow in a wellbore. In one aspect, a flow control device for use in a wellbore is provided. The flow control device includes an inner member having at least one aperture formed therein. The flow control device also includes an outer member disposed around the inner member such that a flow path is defined between the inner member and the outer member. Additionally, the flow control device includes an elastomer member disposed within the outer member adjacent a portion of the flow path, wherein the elastomer member is capable of swelling upon contact with an actuating agent. In another aspect, a method of controlling fluid flow in a wellbore is provided. In yet a further aspect, an apparatus for controlling the flow of fluid in a wellbore is provided.

26 Claims, 3 Drawing Sheets

INFLOW CONTROL DEVICE

BACKGROUND OF THE INVENTION

1. Field of the Invention

Embodiments of the present invention generally relate to the control of fluid flow in a wellbore. More particularly, the invention relates to a flow control apparatus that actuates upon contact with an actuating agent in the wellbore.

2. Description of the Related Art

In hydrocarbon wells, horizontal wellbores are formed at a predetermined depth to effectively reach formations bearing oil or other hydrocarbons in the earth. Typically, a vertical wellbore is formed from the surface of a well and thereafter, using some means of directional drilling like a diverter, the wellbore is extended along a horizontal path. Because the hydrocarbon bearing formations can be hundreds of feet across, these horizontal wellbores are sometimes equipped with long sections of screened tubing. Generally, the screened tubing consists of tubing having apertures therethough and covered with screened walls, leaving the interior of the tubing open to the inflow of filtered oil.

Horizontal wellbores are often formed to intersect narrow oil bearing formations that might have water and gas bearing formations nearby. Even with exact drilling techniques, the migration of gas and water towards the oil formation and the wellbore is inevitable due to pressure drops caused by the collection and travel of fluid in the wellbore. Typically, operators do not want to collect gas or water along with oil from the same horizontal wellbore. The gas and water must be separated at the surface and once the flow of gas begins it typically increases to a point where further production of oil is not cost effective. Devices have been developed that control the flow of fluid in a horizontal wellbore. Generally, these devices are configured to allow oil to flow through the device but upon indication of water, the device actuates to block the flow of water through the device. One such device is a flow control system that includes a tubular having a plurality of production nozzles. The flow control system further includes a plurality of balls which float in water to seal off the plurality of production nozzles when water is present in the formation fluid. Even though the flow control system is capable of controlling the flow of fluid in the horizontal wellbore, the flow control system may not effectively operate when the formation fluid comprises a mixture of fluid. Additionally, the flow control system can be expensive to manufacture.

There is a need therefore for a cost effective flow control device that effectively operates to limit the inflow of gas or water into the production tubing from the surrounding wellbore formations.

SUMMARY OF THE INVENTION

The present invention generally relates to the control of fluid flow in a wellbore. In one aspect, a flow control device for use in a wellbore is provided. The flow control device includes an inner member having at least one aperture formed therein. The flow control device also includes an outer member disposed around the inner member such that a flow path is defined between the inner member and the outer member. Additionally, the flow control device includes an elastomer member disposed within the outer member adjacent a portion of the flow path, wherein the elastomer member is capable of swelling upon contact with an actuating agent.

In another aspect, a method of controlling fluid flow in a wellbore is provided. The method includes the step of inserting a flow control device into the wellbore. The flow control device includes a flow path therethrough and an elastomer member disposed adjacent a portion of the flow path. The method also includes the step of allowing fluid from a formation in the wellbore to flow through the flow path in the flow control device. Further, the method includes the step of exposing the elastomer member to an actuating agent, thereby causing the elastomeric material to swell. Additionally, the method includes sealing off the flow path as a result of the swelling.

In yet a further aspect, an apparatus for controlling the flow of fluid in a wellbore is provided. The apparatus includes a tubular member with at least one aperture formed therein. The apparatus further includes an outer housing disposed on the tubular member. The apparatus also includes a flow path through the apparatus, wherein the flow path includes the aperture in the tubular member. Additionally, the apparatus includes a seal member disposed between the tubular member and the outer housing, wherein the seal member is configured to swell upon contact with an actuating agent and block the flow path through the apparatus.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

The present invention generally relates to an apparatus and method of controlling fluid flow in a wellbore. More specifically, an apparatus is provided that activates upon contact with an actuating agent. As will be described herein, the apparatus relates to a flow control device. It is to be noted, however, that aspects of the present invention are not limited to a flow control device, but are equally applicable to other types of wellbore tools. Additionally, the present invention will be described as it relates to a wellbore having a single flow control device. However, it should be understood that multiple flow control devices may be employed in the wellbore without departing from the principles of the present invention. To better understand the novelty of the apparatus of the present invention and the methods of use thereof, reference is hereafter made to the accompanying drawings.

Figure 1:
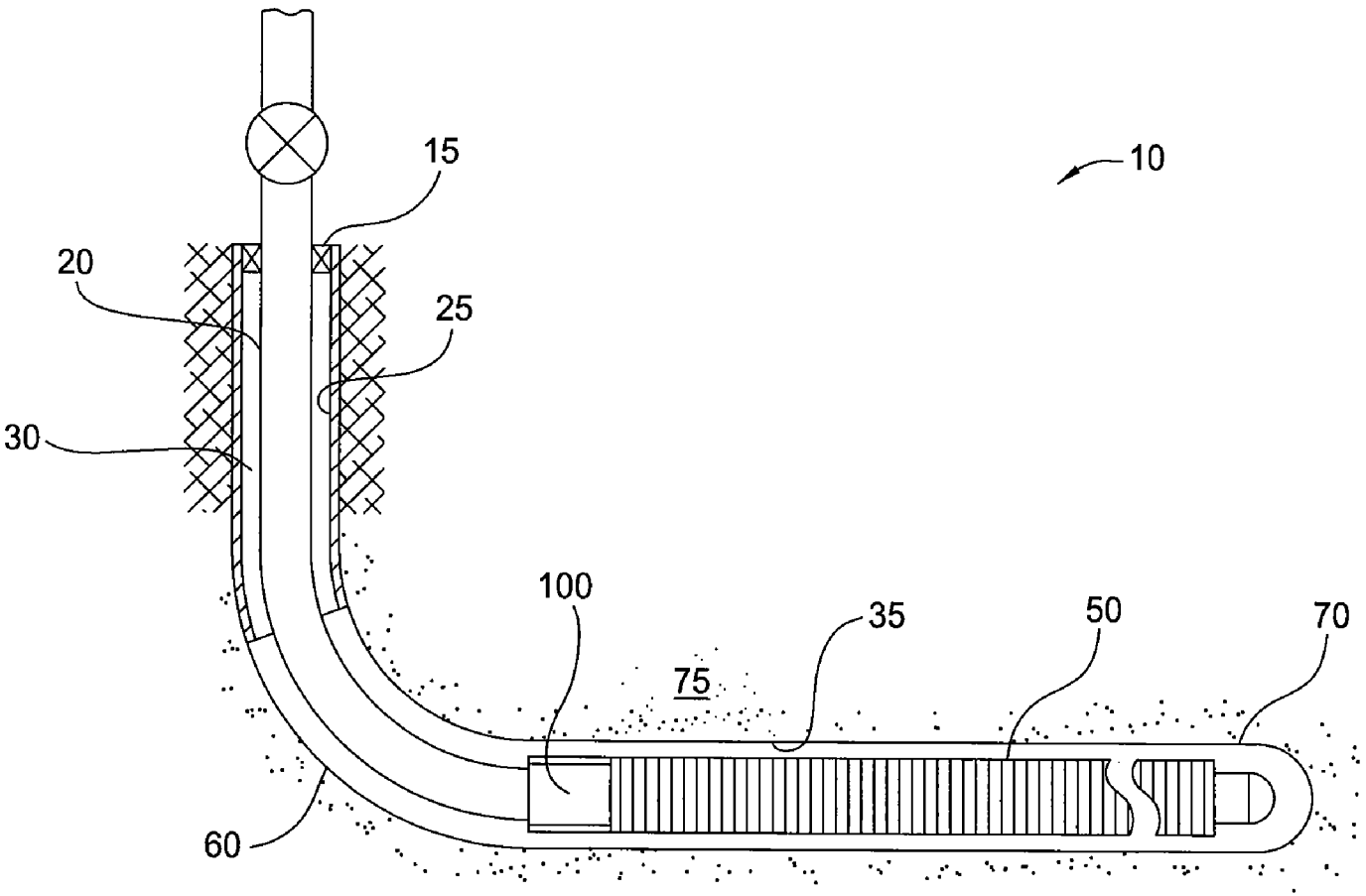
FIG. 1 illustrates a partial cross-sectional view of a flow control apparatus of the subject invention and a sand screen in a horizontal portion of a wellbore.

FIG. 1 illustrates a partial cross-sectional view of a flow control apparatus 100 and a sand screen 50 in a horizontal portion 35 of a wellbore 10. Generally, the apparatus 100 is configured to control the flow of oil or some other hydrocarbon from an underground reservoir 75 through the wellbore 10. The wellbore 10 includes a cased vertical portion 25 and an uncased horizontal portion 35. A production tubing 20 for transporting the oil to the surface of the wellbore 10 is disposed within the vertical portion 25 of the wellbore 10 and extends from the surface of the wellbore 10 through a packing member 15 that seals an annular area 30 around the tubing 20 and isolates the wellbore therebelow. The horizontal portion 35 of the wellbore 10 includes the sand screen 50. The sand screen 50 continues along the horizontal portion 35 of the wellbore 10 to a toe 70 thereof. The apparatus 100 is attached to the sand screen 50 near a heel 60 of the horizontal portion 35 of the wellbore 10.

Figure 2:
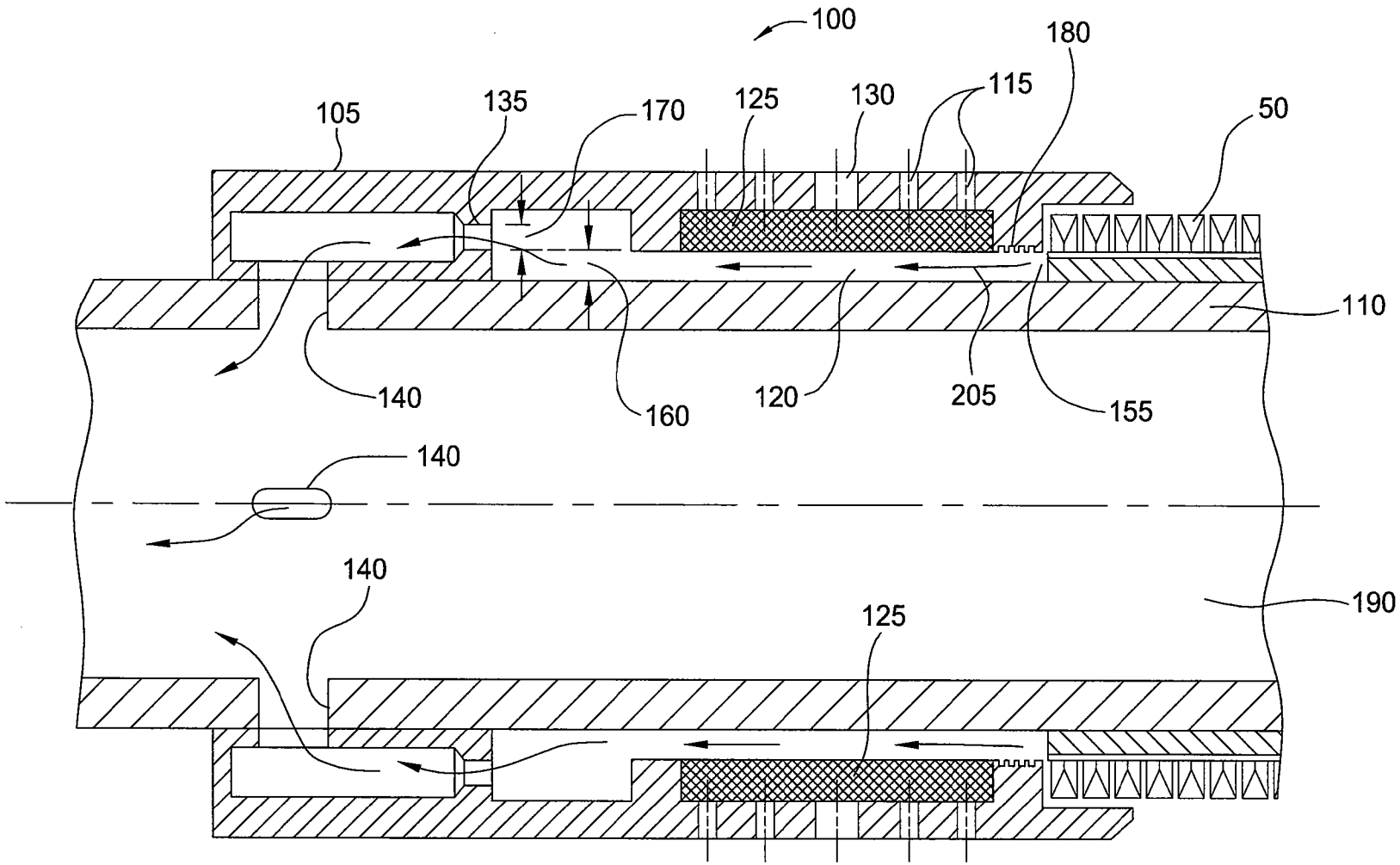
FIG. 2 illustrates a partial cross-sectional view of the flow control apparatus shown in an open position.
Figure 3:
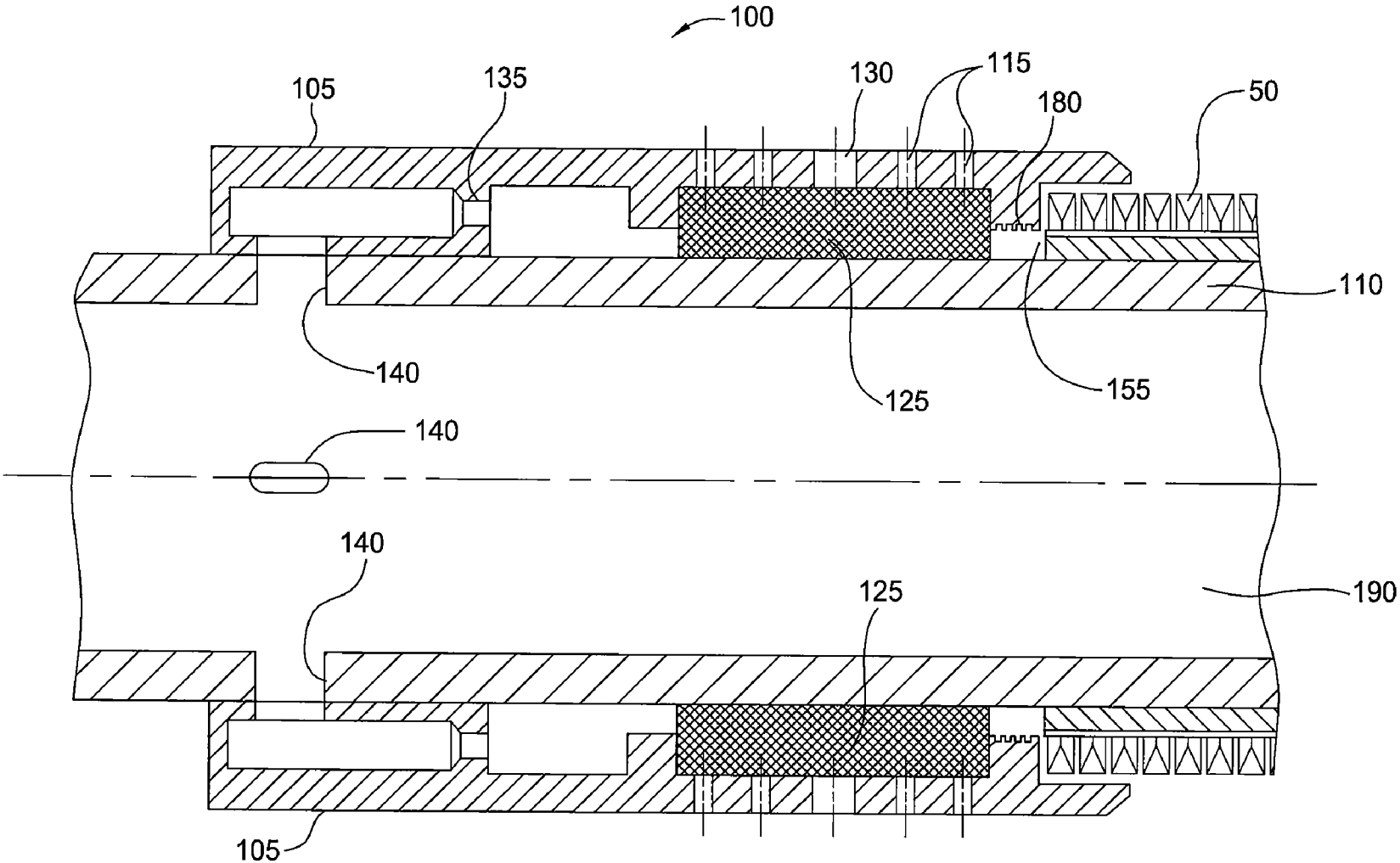
FIG. 3 illustrates another cross-sectional view of the flow control apparatus shown in a closed position.

FIG. 2 illustrates a partial cross-sectional view of the apparatus 100 in an open position and FIG. 3 illustrates a cross-sectional view of the apparatus 100 in a closed position. As will be described herein, the apparatus 100 is configured to move from the open position to the closed position upon contact with an actuating agent.

Referring back to FIG. 2, the apparatus 100 includes an inner tubular body 110 and an outer tubular body 105 disposed therearound. Disposed in an annular area 120 between the inner tubular body 110 and the outer tubular body 105 is an elastomer member 125 that is capable of expanding upon contact with an actuating agent. The expansion and/or swelling of the elastomer member 125 results in increased dimensional properties of the elastomer member 125 in the annular area 120. In other words, the elastomer member 125 will expand or swell in both the longitudinal and radial directions. The amount of expansion and/or swelling depends on the amount of the actuating agent and the amount of absorption by the elastomer member 125. It should also be appreciated that for a given elastomeric material, the amount of swelling and/or expansion is a function not only of the type of actuating agent, but also of physical factors such as pressure, temperature and the surface area of material that is exposed to the actuating agent.

The expansion and/or swelling of the elastomer member 125 can take place either by absorption of the actuating agent into the porous structure of the elastomer member 125, or through chemical attack resulting in a breakdown of cross-linked bonds. In the interest of brevity, use of the terms "swell" and "swelling" or the like will be understood also to relate to the possibility that the elastomer member 125 may additionally or alternatively expand.

The elastomer member 125 is typically a rubber material, such as NITRILE™, VITON™, AFLAS™, Ethylene-propylene rubbers (EPM or EPDM), and KALREZ™. The actuating agent is typically a fluid, such as water. In another embodiment, the actuating agent is gas. The actuating agent used to actuate the swelling of the elastomer member 125 can either be naturally occurring in the wellbore 10 or with other specific fluids. The type of actuating agent that causes the elastomer member 125 to swell generally depends upon the properties of the material and, in particular, the hardening matter, material, or chemicals used in the elastomer member 125.

The amount of swelling of the elastomer member 125 depends on the type of actuating agent used to actuate the swelling, the amount of actuating agent, and the amount of elastomer member 125 exposed to the actuating agent. The amount of swelling of the elastomer member 125 can be controlled by controlling the amount of actuating agent that is allowed to contact the elastomer member 125 and the length of time the actuating agent contacts the elastomer member 125. For instance, the material may only be exposed to a restricted amount of fluid where the material can only absorb this restricted amount. Thus, swelling of the elastomer member 125 will stop once all the fluid has been absorbed by the material.

The elastomer member 125 can typically swell by around 5% (or less) to around 200% (or more) depending upon the type of elastomeric material and actuating agent used. If the particular properties of the material and the amount of fluid that the material is exposed to are known, then it is possible to predict the amount of expansion or swelling. It is also possible to predict how much material and fluid will be required to fill a known volume.

The structure of the elastomer member 125 can be a combination of swelling or expanding and non-swelling or non-expanding elastomers. Furthermore, the outer surfaces of the elastomer member 125 may be profiled to enable maximum material exposure to the swelling or expanding medium. In the interest of brevity, non-swelling and non-expanding elastomeric material will be referred to commonly by "non-swelling", but it should be appreciated that this may include non-expanding elastomeric materials also.

The non-swelling elastomeric material can be an elastomer that swells in a particular fluid that is not added or injected into the wellbore 10 or is not naturally occurring in the wellbore 10. Alternatively, the non-swelling elastomeric material can be an elastomer that swells to a lesser extent upon contact with an actuating agent. As a further alternative, a non-swelling polymer (e.g. a plastic) may be used in place of the non-swelling elastomeric material. For example, TEFLON™, RYTON™, or PEEK™, may be used. It should be appreciated that the term "non-swelling elastomeric material" is intended to encompass all of these options.

In some situations, the elastomer member 125 in the apparatus 100 may begin to swell as soon as the apparatus 100 is located in the wellbore 10 as the fluid that actuates the swelling may be naturally occurring in the borehole. In this case, there is generally no requirement to inject chemicals or other fluids to actuate the swelling of the elastomer member 125. Additionally, it is possible to delay the swelling of the elastomer member 125. This can be done by using chemical additives in the base formulation that causes a delay in swelling. The type of additives that may be added will typically vary and may be different for each elastomer member 125 depending on the base polymer used in the material. Typical pigments that can be added that are known to delay or have a slowing influence on the rate of swelling includes carbon black, glue, magnesium carbonate, zinc oxide, litharge, and sulfur.

In another embodiment, the elastomer member 125 can be at least partially or totally encased in a water-soluble or alkali-soluble polymeric covering. The covering can be at least partially dissolved by the water or the alkalinity of the water so that the actuating agent can contact the elastomer member 125. This can be used to delay the swelling by selecting a specific soluble covering. The delay in swelling can allow the apparatus 100 to be located in the wellbore 10 before the swelling or a substantial part thereof takes place. The delay in swelling can be any length of time.

The mechanical properties of the elastomer member 125 can be adjusted or tuned to specific requirements. For instance, chemical additives such as reinforcing agents, carbon black, plasticizers, accelerators, activators, anti-oxidants, and pigments may be added to the base polymer to have an effect on the final material properties, including the amount of swell. These chemical additives can vary or change the tensile strength, modulus of elasticity, hardness, and other factors of the elastomer member 125.

As shown in FIG. 2, the apparatus 100 may optionally include a plurality of ports 115 formed in the tubular body 105. The ports 115 are configured as a fluid pathway to allow an actuating agent on the outer portion of the apparatus 100 to contact the elastomer member 125. In other words, the actuating agent can enter the ports 115 to cause the elastomer member 125 to expand into the annular area 120. The apparatus 100 may also optionally include a fill hole 130 formed in the tubular body 105. The fill hole 130 is configured to allow the placement of the elastomer member 125 adjacent the annulus 120 when the apparatus 100 is assembled.

Generally, the production fluid flows through the screen 50 and into the apparatus 100 via a pathway 155 as indicated by a fluid pathway arrow 205. The production fluid then flows through the annular area 120 into a flow port 135 formed in the tubular body 105 and subsequently into a bore 190 of the tubular body 110 via a plurality of apertures 140. Thereafter, the production fluid flows through the production tubing and out of the wellbore.

The flow port 135 is formed in the tubular body 105 such that production fluid entering the screen 50 can flow into the bore 190 of the tubular body 110. A gap 160 between the outer tubular body 105 and the inner tubular body 110 is sized such that the total area 170 of the flow port 135 is smaller than the gap 160. This arrangement allows the creation of a pressure drop in the area of the flow port 135 which may increase the flow pressure of the production fluid as the production fluid enters into the production tubing via the plurality of apertures 140.

The outer tubular body 105 may optionally include a plurality of cutouts 180 (or ridges) proximate the pathway 155, as shown in FIG. 2. The cutouts 180 are configured to diffuse the flow of the production fluid in order to prevent damage to the elastomer member 125. In other words, as the production fluid flows through the screen 50 into the pathway 155, the production fluid is defused such that the turbulence of the fluid is substantially reduced. The cutouts 180 are an optional feature employed to protect the elastomer member 125 as the production fluid flows past the elastomer member 125.

FIG. 3 illustrates is a cross-sectional view of the apparatus 100 shown in a closed position. The apparatus 100 is configured to activate or close upon contact with water (actuating agent) in order to minimize the amount of water entering the production tubing. In other words, as water from the reservoir flows through the screen 50 and into the apparatus 100 via the pathway 155, the water contacts the elastomer member 125, thereby causing the elastomer member 125 to swell. As the elastomer member 125 swells, it expands and thus creates a seal in the annular area 120. The seal may be independent of the annular area 120 as the elastomer member 125 will swell and continue to swell upon absorption of the water to substantially fill the annular area 120 between the inner tubular body 110 and the outer tubular body 105. As the elastomer member 125 swells, the elastomer member 125 will go into a compressive state to provide a tight seal in the annular area 120. The seal prevents flow of fluid through the apparatus 100. In this manner, the flow path between the screen and the production tubing is closed.

Upon swelling, the elastomer member 125 retains sufficient mechanical properties (e.g. hardness, tensile strength, modulus of elasticity, elongation at break, etc.) to withstand differential pressure between the inner tubular body 110 and the outer tubular body 105. The mechanical properties can be maintained over a significant time period so that the seal created by the swelling of the elastomer member 125 does not deteriorate over time.

Although the apparatus 100 has been described in relation to a flow control device, the aspects of the present invention are equally applicable to other types of wellbore tools, such as sliding sleeves, slotted liners, and well screens, that require shutoff of water production in an oil or gas well.

While the foregoing is directed to embodiments of the present invention, other and further embodiments of the invention may be devised without departing from the basic scope thereof, and the scope thereof is determined by the claims that follow.

The invention claimed is:

1. A flow control device for use in a wellbore, the flow control device comprising:

an inner member;

an outer member disposed around the inner member and forming an annular chamber therebetween, wherein the annular chamber is in fluid communication with the inner member at a first end and in fluid communication with the wellbore at a second end and isolated from the wellbore therebetween;

a fluid restriction port disposed between the first and second ends of the annular chamber; and an annular elastomer member disposed within the annular chamber, wherein the elastomer member is configured to swell upon contact with an actuating agent and expand to at least partially seal a flow path through the annular chamber.

2. The flow control device of claim 1, wherein the fluid restriction port is configured to increase fluid pressure of a fluid traveling through the flow path.

3. The flow control device of claim 1, wherein the outer member includes a plurality of cutouts configured to diffuse a flow of fluid in the flow path to substantially prevent damage to the elastomer member.

4. The flow control device of claim 1, wherein the actuating agent is naturally occurring within the wellbore.

5. The flow control device of claim 1, wherein the actuating agent comprises water.

6. The flow control device of claim 1, wherein the elastomer member swells upon contact with the actuating agent due to absorption of the agent by the elastomer member.

7. The flow control device of claim 1, further including a cover disposed on a portion of the elastomer member.

8. The flow control device of claim 7, wherein the cover substantially prevents the elastomer member from actuating.

9. The flow control device of claim 7, wherein the cover is dissolvable.

10. The flow control device of claim 1, wherein the outer member includes a plurality of holes formed therein to allow the actuating agent to contact the elastomer member.

11. The flow control device of claim 1, wherein the elastomer member is disposed within a recess formed in the outer member.

12. The flow control device of claim 11, wherein the elastomer member includes a first configuration in which the elastomer member is positioned away from the flow path and a second expanded configuration in which a portion of the elastomer member is positioned within the flow path to seal an annulus formed between the inner member and the outer member.

13. A method of controlling fluid flow in a wellbore, the method comprising:

inserting a flow control device into the wellbore, the flow control device having an outer member disposed around an inner member such that an annular chamber is formed therebetween, a fluid restriction port and an elastomer member;

allowing fluid from a formation in the wellbore to flow through the fluid restriction port disposed between a first portion and a second portion of the annular chamber;

exposing the elastomer member to an actuating agent, thereby causing the elastomer member to swell; and at least partially sealing off a flow path through the annular chamber as a result of the swelling.

14. The method of claim 13, wherein the actuating agent is water in the wellbore.

15. The method of claim 13, further including defusing the flow of fluid as the fluid enters into the flow path in order to substantially protect the elastomer member in the flow control device.

16. The method of claim 13, further including pressurizing the fluid as the fluid travels into the second portion of the annular chamber.

17. The method of claim 13, wherein the flow control device further comprises a protective cover at least partially disposed on a portion of the elastomer member to delay the rate of swelling of the elastomer member.

18. The method of claim 17, further including dissolving the protective cover at a predetermined time.

19. The method of claim 13, wherein exposing the elastomer member to the actuating agent causes the elastomer member to swell such that a portion of the annular elastomer member extends into the flow path to seal the flow path.

20. The method of claim 13, wherein fluid flow enters a bore of a tubular via the aperture.

21. The method of claim 20, wherein fluid flow into the bore of the tubular is stopped when the elastomer swells and seals off the flow path.

22. An apparatus for controlling the flow of fluid in a wellbore, the apparatus comprising:

a tubular member having at least one aperture formed therein, an outer housing disposed on the tubular member and forming a flow path therebetween;

a fluid restriction port formed in the outer housing; and a seal member having an inner surface and an outer surface, wherein the inner surface and the outer surface are exposed to fluid and wherein the seal member configured to swell upon contact with an actuating agent and at least partially block the flow path.

23. The apparatus of claim 22, wherein the actuating agent is water in the wellbore.

24. The apparatus of claim 22, wherein the outer member includes a plurality of ridges formed in the outer member, wherein the ridges are configured to diffuse a flow of fluid in the flow path to substantially prevent damage to the seal member.

25. The apparatus of claim 22, wherein the seal member is disposed in a recessed portion of the outer housing such that the seal member is spaced apart from the flow path and upon contact with the actuating agent, the seal member extends into the flow path to block the flow path.

26. The apparatus of claim 22, wherein the outer surface of the seal member is exposed to fluid via a plurality of holes formed in the outer housing.

* * * * *